US007102101B1

(12) United States Patent
Johnson et al.

(10) Patent No.: US 7,102,101 B1
(45) Date of Patent: Sep. 5, 2006

(54) HIGH VOLTAGE CIRCUIT BREAKER WITH INTERNAL TANK HEATER

(75) Inventors: David S. Johnson, Greensburg, PA (US); Jeffry R. Meyer, Greensburg, PA (US); Daniel C. Schiffbauer, Uniontown, PA (US)

(73) Assignee: Pennsylvania Breaker LLC, Canonsburg, PA (US)

( * ) Notice: Subject to any disclaimer, the term of this patent is extended or adjusted under 35 U.S.C. 154(b) by 0 days.

(21) Appl. No.: 11/244,926

(22) Filed: Oct. 6, 2005

(51) Int. Cl.
*H05B 1/00* (2006.01)

(52) U.S. Cl. ..... 219/201; 219/213; 392/447

(58) Field of Classification Search ..... None
See application file for complete search history.

(56) References Cited

U.S. PATENT DOCUMENTS 3,045,086 A * 7/1962 Leeds et al. ..... 218/68
3,118,995 A 1/1964 Colclaser, Jr. et al.
3,358,104 A 12/1967 Cromer et al.
3,566,062 A 2/1971 Meier et al.
3,935,408 A 1/1976 Taylor
3,983,353 A * 9/1976 Guaglione et al. ..... 218/51
4,006,332 A 2/1977 Crookston et al.
4,024,365 A * 5/1977 Soles et al. ..... 218/44
4,208,556 A 6/1980 Patel et al.
4,434,335 A * 2/1984 Natsui et al. ..... 218/83
4,771,258 A * 9/1988 Arnold ..... 337/77
5,388,451 A * 2/1995 Stendin et al. ..... 73/438
6,147,333 A 11/2000 Mattson
6,307,172 B1 10/2001 Bolin et al.

FOREIGN PATENT DOCUMENTS

WO WO 2002/103734 12/2002

* cited by examiner

*Primary Examiner*—Thor S. Campbell
(74) *Attorney, Agent, or Firm*—Pepper Hamilton LLP

(57) ABSTRACT

A high voltage circuit breaker with a gas-insulated tank is provided. Enclosed with the tank is an elongated heater having at least one heating element enclosed in an outer tube. The heater is located coaxially within the tank and is surrounded by the insulating gas.

20 Claims, 5 Drawing Sheets

HIGH VOLTAGE CIRCUIT BREAKER WITH INTERNAL TANK HEATER

BACKGROUND

1. Technical Field

The disclosure contained herein generally relates to high-voltage circuit breakers, and particularly to circuit breakers with gas-insulated tanks.

2. Description of the Related Art

Gas-insulated circuit breakers are known. Such circuit breakers generally include separable contact elements contained within a sealed tank filled with an inert insulating gas for reducing arcing. The gas is typically sulfur hexaflouride ($SF_6$) due to its good insulative and arc interruption properties. The gas system for a circuit interrupter is typically a two-pressure closed cycle arrangement utilizing an efficient dielectric insulating gas such as $SF_6$ gas, alone or in combination with other gases such as nitrogen or tetrafluoromethane. The high pressure gas is provided for the purpose of effecting arc extinction between the separable contacts of the circuit breaker. As a current interrupting medium, $SF_6$ enables the extinction of high current arcs across the circuit-breaker contacts so as to accomplish the switching function, which is the main purpose of high voltage circuit breakers. Additionally, the low pressure gas inherently found within the enclosure provides the required dielectric insulation between the live or energized components within the grounded enclosure. The gas may be contained at a high pressure within a holding chamber, generally constructed of non-conducting material such as fiberglass, located within the enclosure.

Extinction of the arcs drawn between the contacts of the interrupter in the arcing area at the axial end of the movable contacts is aided by means of a blast of high pressure gas to the arcing area. The blast of high pressure gas may be released by operation of a blast valve. The opening operation of the blast valve may be synchronized with the opening of the contacts and may be accomplished by an associated linkage. A description of an exemplary blast valve, contacts and operating linkage may be found in U.S. Pat. No. 3,852,548, the disclosure of which is incorporated herein by reference in its entirety.

Gas type circuit breakers include puffer-type circuit interrupters and gas-blast interrupters. Puffer-type breakers generally comprise a pneumatic self-blast device which blows dielectric gas in the direction of the arc at the time of opening. A self-blast or puffer of this kind conventionally comprises a compression chamber including a piston coupled to a mobile contract of the circuit-breaker to move with it and adapted to blow a constant volume of cool gas in the direction of the breaking space during each opening. Gas-blast interrupters generally comprise the mechanically driven compression chamber and an additional chamber, located in between the compression chamber and the breaking space. The additional chamber is a thermal blast chamber wherein the gas is heated by the electrical arc. This gas is blasted onto the breaking space during interruption.

Other examples of blast mechanisms include the circuit breakers described in U.S. Pat. Nos. 4,650,941; 6,307,172; and 6,744,001, the disclosures of each of which are herein incorporated by reference in their entirety. In U.S. Pat. No. 4,650,941, a compressed gas high tension circuit breaker is described that uses a differential piston mechanism to separate the contacts and thus interrupt the circuit. U.S. Pat. No. 6,307,172 describes a high voltage circuit breaker with a gas-insulated tank enclosing separable contacts, which also includes a particle trap design. U.S. Pat. No. 6,744,001 describes a high voltage circuit breaker which includes a valve for decompressing a thermal belt chamber to deliver a dielectric gas to the breaking space for circuit interruption. Means of moving the separable contacts may include, for example, pneumatic and hydraulic systems, cam-spring systems, etc.

In circuit breakers of this type, $SF_6$ gas is typically used as both an electrical insulating medium for high voltage components and also as a current interrupting medium. $SF_6$ as an electrical insulating medium allows for reduced gaps between high voltage components and ground potential surfaces. $SF_6$ gas as a current interrupting medium enables the extinction of high current arcs across the circuit-breaker contacts so as to accomplish the switching function, which is the main purpose of high voltage circuit breakers.

$SF_6$ gas can be used alone or as a component in gas mixtures of $SF_6$ and other gases. The density of the gas so employed is such that, at temperatures lower than some usual level (negative 30 degrees Centigrade, for example), liquefaction of the gas occurs and this diminishes the effective density of the remaining gas still in the gaseous physical state. This effect can create problems in some locations. For example, in some locations in North Dakota, Wisconsin, Minnesota and elsewhere, temperatures can drop well below −30° C.

Because of this low temperature limit that is dictated by physical laws of the gas, in low temperature locations, heaters are sometimes used to raise the temperature of the gas and therefore maintain appropriate densities in the gaseous state. Prior art designs use various heating configurations external to the metal enclosure of the high voltage circuit breaker, so as to achieve this heating of the gas. Such configurations include "blanket heaters" installed around the external surface of the tank, "box-type" heaters mounted directly on the tank wall, and other heating element types mounted in some way to accomplish heating of the gas. These external heater configurations have been combined with external thermal insulation to improve the overall efficiency of the gas heating function. Examples of such heaters are disclosed in, for example, U.S. Pat. No. 6,147,333 and International Patent Application No. WO 2002103734, the disclosures of each of which are incorporated herein by reference.

The external heater designs suffer from limited heating efficiency, as the heat that is ultimately delivered to the gas must pass through the tank wall before reaching the gas. Meanwhile, losses to the external environment are significant because of the external location of the heating element, and the temperature differential maintained between the heater element and that internal gas needed to accomplish significant heat transfer to that gas.

External heater designs are typically difficult to install or to exchange due to the need to maintain intimate contact with the external tank surfaces over the entire heating element area. Because of the placement of prior art heaters, hot spots in the heating element may develop, and heater failure can and does occur. As circuit breaker enclosures (tanks) are typically not perfectly round or flat, maintaining this intimate contact over the entire heating area is problematic. Further, temperature variations resulting from the external environment or from the heater operation may vary the dimensions of the tank and heater, alter material properties of the components of the enclosure, and accordingly modify heat transfer characteristics within the overall heater design. Solutions to this problem might include use of glues between the heater element and the external tank surface, or "belly-bands" to hold and compress the heater element onto the tank, or both.

Another limitation of typical external heater designs is that the heat is applied for a relatively short portion of the enclosure length, usually in the mid-section of a tank due to geometric constraints of the tank shape. This creates a very non-uniform temperature distribution in the gas in cold weather situations, the ends being much colder than the middle of the enclosure. Since pressure inside the gas volume is constant, density varies directly with temperature and the gas density varies significantly throughout the gas volume of the enclosure. This tends to actually reduce the gas density in the mid-section where the interrupters of the circuit breaker normally are located and thus reduce the electrical insulation and the current interruption capacity of the interrupter. Correct monitoring of the gas density at the interrupter (usually done by measuring temperature and pressure) is also quite difficult due to the large variations in temperature and gas density throughout the enclosure. Monitoring is often non-conservative, allowing operation of the circuit breaker even though the actual capacity is well below limits specified by required standards. Failure of the circuit breaker may result.

It is also desirable that circuit breaker designs allow for the control of conductive particles. An assembled circuit breaker tank can contain undesirable foreign particles, such as dust and metal shavings from machined parts. Additionally, when an arc exists across the contacts, heating of the contacts may result in the creation of conductive particles. It is undesirable for such particles, particularly metallic conductive or semiconductive particles, to freely reside within the tank. Such particles, if permitted to remain free, can interfere with the operation of the circuit breaker, causing undue arcing, flashing or promoting breakdown between metallic components. The presence of particles greatly reduces the breakdown voltage of the circuit breaker. Although unlikely, it is also possible that hardware such as nuts, washers, screws, etc., could work loose during operation. Sensitivity to particles increases with the voltage across the circuit breaker due to the increased electric field stress levels. Circuit breakers are now constructed capable of handling very high voltages, for example 362 kV and higher.

In a conventional tank, the operation of the contacts can cause such particles to move about the tank. For example, it is known that the operation of opening and closing the contacts causes shocks and vibrations capable of moving loose particles within the tank. Also, in a "puffer" type circuit breaker, the operation of opening the contacts results in flows of $SF_6$ gas capable of blowing loose particles around the tank. Traps for foreign particles have been proposed in circuit breakers, such as the design seen in U.S. Pat. No. 6,307,172, the disclosure of which is incorporated herein by reference.

It is therefore desirable provide a circuit breaker with an improved means for maintaining the gas density and temperature throughout the interior chamber. The disclosure contained below is directed to solving one or more of the above-described problems.

SUMMARY

In accordance with one embodiment, a circuit breaker includes a contact mechanism movable between an open and closed position, a driving mechanism operable to drive the contact mechanism between the open and closed positions, a tank having at least one wall defining an interior chamber enclosing the contact mechanism, the interior chamber being filled with an insulating gas, and an elongated heating assembly having at least one heating element enclosed in an outer tube. The heating assembly is located within the tank, and is at least partially surrounded by the insulating gas.

A circuit breaker may include any heater that is installed internally to the $SF_6$ enclosure. By internal installation of the heater, heat is transferred more directly into the gas, minimizing losses to the external environment. Rather than external heating of the tank so as to transfer heat to the gas inside through the tank wall, the heat is transferred directly to the gas.

The heater design may also function as a particle trap for conductive particles found within the interior chamber of the tank. The insulating gas may be sulfurhexafluoride, tetraflurometh ane, nitrogen, carbon dioxide, and/or mixtures or equivalents thereof. The heater may include at least one heating element and a retaining tube protecting the heating element(s) from the surrounding insulating gas.

In accordance with another embodiment, an elongated heating assembly is sized to be removably placed into a tank for an insulating gas-type circuit breaker. The assembly comprises at least one heating element fitted within in a retaining tube.

BRIEF DESCRIPTION OF THE DRAWINGS

Various aspects and applications of the present invention will become apparent to the skilled artisan upon consideration of the brief description of the figures and the detailed description of the invention, which follows.

DETAILED DESCRIPTION

Figure 1:
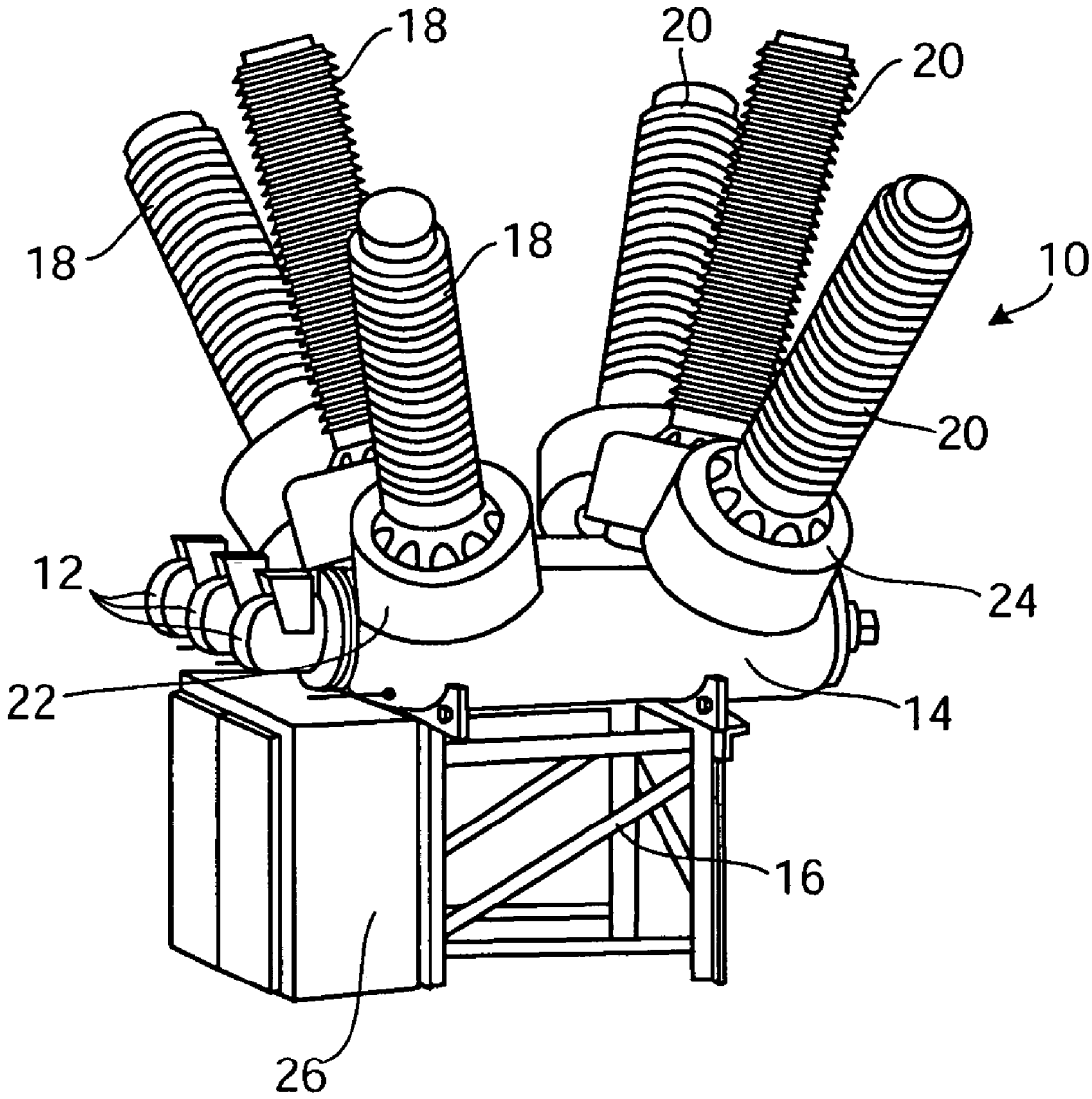
FIG. 1 is a perspective view of a high-voltage circuit breaker station having three phases.

Before explaining at least one embodiment in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting. For example, all singular forms and the words "a," "an," and "the" include the plural reference unless expressly stated otherwise.

It must also be noted that as used herein and in the appended claims, the singular forms "a", "an", and "the" include plural reference unless the context clearly dictates otherwise. Thus, for example, reference to a "contact" is a reference to one or more contacts and equivalents thereof known to those skilled in the art, and so forth. Unless defined otherwise, all technical and scientific terms used herein have the same meanings as commonly understood by one of ordinary skill in the art. Although any methods and materials similar or equivalent to those described herein can be used in the practice or testing of embodiments of the present invention, the preferred designs, methods, devices, and materials are now described. All publications mentioned herein are incorporated by reference in their entirety. Nothing herein is to be construed as an admission that the invention is not entitled to antedate such disclosure by virtue of prior invention.

Embodiments described herein may be incorporated into any variety of gas-type circuit breakers including, for example, both puffer and gas-blast designs. The embodiments described herein may be used in the gas enclosure design of both high voltage dead tank circuit breakers and in such circuit breakers integrated into gas insulated substation systems. The embodiments described herein may be used in one or more tanks of a three phase tank circuit breaker, as well as in a single tank of a multi-phase circuit breaker. Three phase tank designs are generally known in the art and may have configurations such as those described in U.S. Pat. Nos. 6,686,553; 6,437,276; and 4,027,125, the disclosures of each of which are herein incorporated by reference in their entirety. For simplicity, the heater embodiments are described as incorporated into puffer-type breakers, and such description should be construed as illustrative, not limiting.

In various embodiments, the circuit breaker may be a high voltage circuit breaker, such as a circuit breaker designed to be operated at least approximately 69 kilovolts (kV), or between about 50 kV and about 800 kV. Other voltages are possible.

Now referring to the drawings, FIG. 1 illustrates an exemplary three-phase circuit breaker assembly 10. An exemplary circuit breaker assembly 10 includes three horizontal circuit breakers 12, each having an exterior tank 14 mounted to a frame 16 supported on the ground. Optionally, the tanks 14 may be grounded to a frame 16, so that the circuit breaker 10 is a "dead tank" type circuit breaker. Each of the circuit breakers 12 may include an entrance insulator 18 and a corresponding exit insulator 20 extending outwardly from opposite sides of the respective tanks 14. Current transformers 22 and 24 are respectively mounted to each of the entrance and exit insulators 18 and 20 near the tank 14. Each of the circuit breakers 12 may have, contained within a tank 14, an operating mechanism and controller such as those that are generally well-known for driving contact components within the tank 14, for selectively opening and closing a circuit between the respective entrance 18 and exit 20 insulators. The tank 14 includes a contact mechanism that moves between an open position and a closed position. An insulating gas such as $SF_6$ surrounds the contact mechanism in the tank to prevent arcing when the contact mechanism is open.

A suitable circuit breaker may have a generally cylindrical shape with two end plates, although other shapes are possible. A circuit breaker may have a contact assembly, such as a stationary and movable assembly to perform the breaking function. The interior cavity of the tank may be insulated with an insulating gas, such as $SF_6$ or some other appropriate gas. Although circuit breakers are known wherein the $SF_6$ gas is maintained at ambient pressure, the $SF_6$ gas is usually pressurized to approximately 70 psig or higher. Other suitable insulating gases include, without limitation, alone or in combination with $SF_6$, tetrafluoromethane, nitrogen, carbon dioxide, and/or mixtures thereof.

The stationary and movable contact assembly may be cooperatively configured for relative movement. A driver or similar mechanism may be used to move the movable contact assembly selectively between open and closed circuit positions. Various mechanisms may be used to move the movable assembly between its positions, including pneumatic and hydraulic systems, cam-spring systems, and the like. The movable stationary contact assemblies may be shaped in a suitable configuration, such as male and female assemblies operatively connected in the closed position. For the open position, the circuit is interrupted using a puff of the insulating gas.

For reducing arcing between the contacts during interruption of the circuit, the contact assembly may be designed to provide a puff of the insulating gas into the interrupting space formed between the separated contacts. One such design is a puffer chamber which becomes compressed by the relative motion of the separating contact. If the chamber is compressed, the volume of the insulating gas within the chamber in decreased and thus its pressure increased. The pressurized insulating gas may escape from the puffer chamber and thus be blasted or puffed into the interrupting space to enhance cooling and arc reduction.

The density of the gas so employed may be such that, at temperatures lower than some usual level (−30 degrees Centigrade, for example), liquefaction of the gas may occur. This can diminish the effective density of the remaining gas still in the gaseous physical state.

Figure 2:
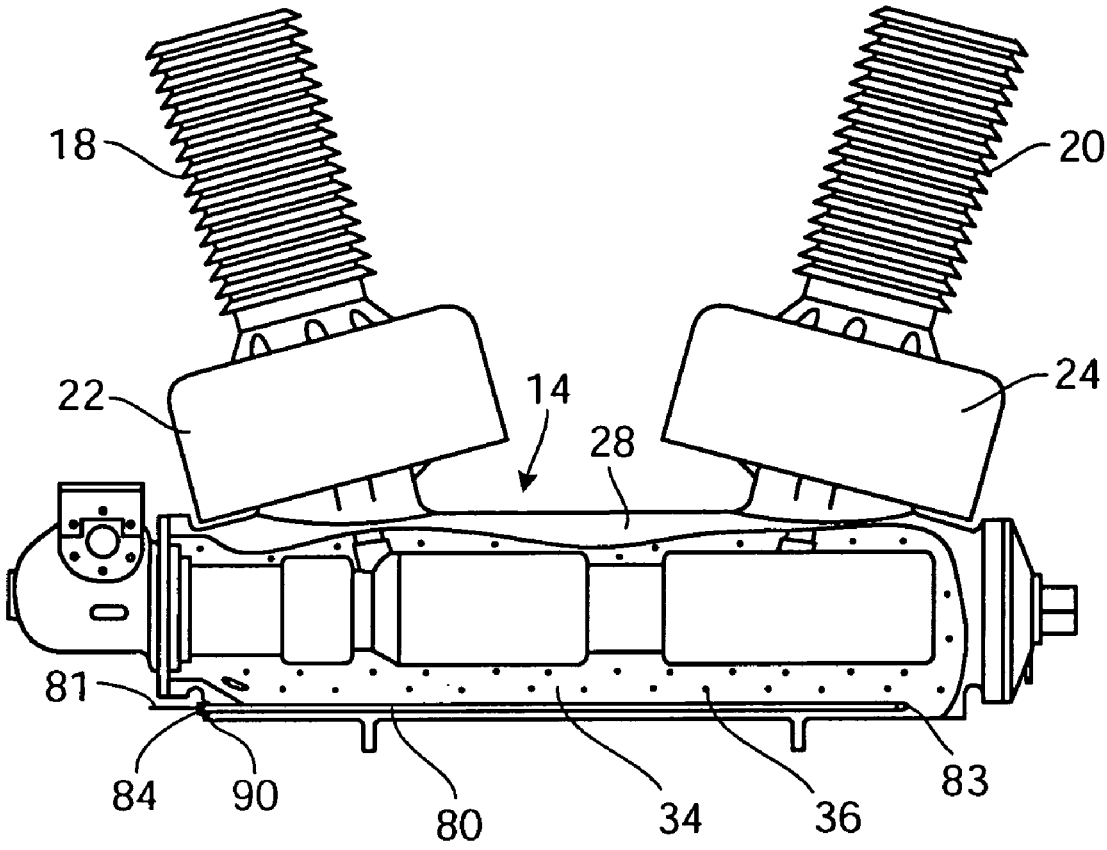
FIG. 2 is a cut-away cross-sectional side view of a circuit breaker having an elongated heater within the interior chamber of the tank, constructed in accordance with teachings of the present invention.
Figure 3:
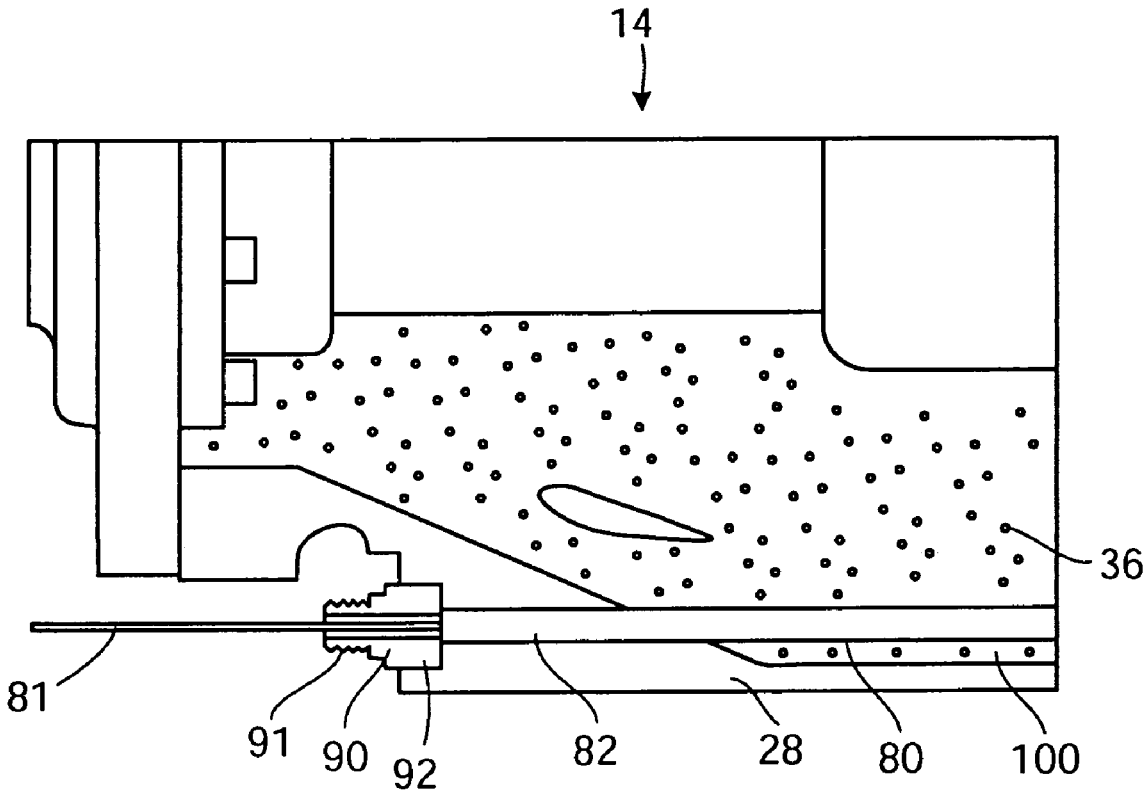
FIG. 3 is a cut-away cross-sectional side view of the circuit breaker of FIG. 3 illustrating the accessibility of the heater through an opening in the tank.

In order to maintain the internal gas at a desired temperature, in the embodiments described herein an internal heater effectively maintains the insulating gas temperature and density. As seen in FIGS. 2 and 3, a high voltage circuit breaker may be designed with an internal elongated heater 80, such that it is internal to the $SF_6$ enclosure. By internal installation of the heater 80, heat is transferred more directly into the gas 36, minimizing losses to the external environment. Rather than exterior heating of the enclosure so as to transfer heat to the gas inside, the heat is transferred directly to the gas, rather than through the walls 28 of the enclosure is only after the gas 36 has been heated. The elongated heater 80 may be included in any suitable circuit breaker employing an insulating gas.

Figure 4:
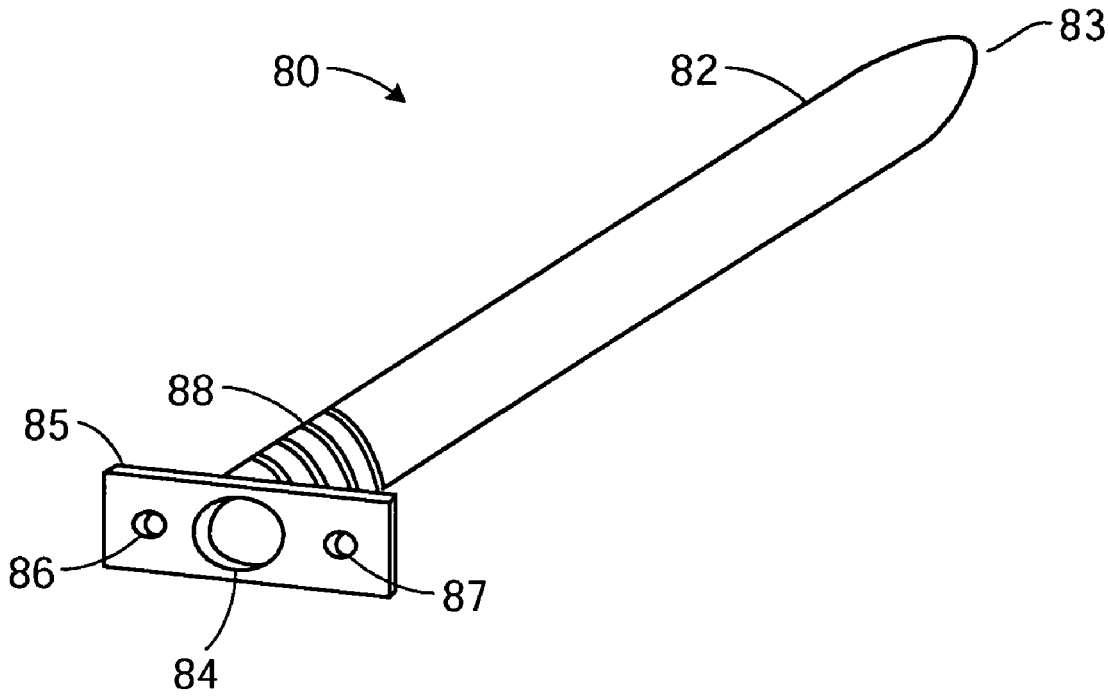
FIG. 4 illustrates an exemplary heating tube and element.

As seen in FIG. 4, the internal heater assembly design 80 includes a heating element 81 and elongated tube 82. Tube 82 is preferably made of a sturdy, heat-conducting material, such as aluminum, nickel-coated steel or stainless steel. Tube 82 is open at one end 84 and closed at the other 83 so that the tube may accept a heater element 81 at the open end 84. Heating element 81 is a conductive element, such as copper, steel or other material insertion into the elongated tube 82 at the open end 84. Heater assembly 80 may include a tube 82 sized to fit into a tank opening, a closed end 83, and an open end 84 that accepts a heating element. Heating assembly 80 may also include a stop member 84 or other fitting such as a plate or other member that prevents to be 82 from completely entering the tank. Optionally, stop member 85 may include one or more openings 86, 87 to accept a bolt or other means for securing the stop member 85 to the tank. Alternatively or in addition, tube 82 may be fully or partially threaded so that the threads 88 may secure the tube to an opening in the tank. Other means for securing heating element 80 to the tank are possible.

Referring again to FIGS. 2 and 3, heater assembly 80 may run all or substantially all of the length of the enclosure, fitting coaxially inside the tank 14. The heater 80 is thus at least partially surrounded by the insulating gas medium 36 as indicated by lower casting 100. The heat from element 81 is exchanged to the casing or tube 82 surface, and then passes directly to the gas system 36. As noted above, the heating element 81 may be made of a conductive material such as copper, while the tube 82 and tank 14 may be made of more durable substances such as cast aluminum.

In use, the tube 82, as with other contents of the interior cavity 34 of the tank 14, is exposed to the enclosure pressure on the external wall 28 of the tank, but is not necessarily internally pressurized. Thus, the tube 82 may be accessed from outside the enclosure via tank outlet 90 without depressurizing the gas system 36. The heating element 81 is inserted into the tube 82 from the outside, and thus may be sealed against environmental assaults. Thus, the tube 82 includes an opening through which the heating element 81 may be replaced. Further, the heating element 81 may be removed from the tube 82 without removing the gas inside the tank. Optionally, the heating element 81 may be removed from the tube 82 without disturbing the electrical field inside the tank.

Tank 14 may include an outlet 90, such as a circular opening that accepts tube and the design may include various fittings such as electrical wires in order to supply power to the heating element 81. The assembly 90 comprises entry into the interior cavity 92. In one embodiment, the entry has about a 1.5 inch diameter into the wall of the tank to accept a tube having a diameter less than 1.5 inches. Other sizes are possible.

Additionally, as seen in FIG. 4, the outlet 90 may be fitted with a seal 91, which may be a thread assembly and an O-ring made of a flexible material such as rubber. Optionally, two O-rings may be used to form the seal. The threaded assembly 91 may accept conduit. Other gasketing is also suitable.

Optionally, the heating element 81 may be immersed or surrounded in a thermally conductive substance within the tube 82 so as to improve heat transfer to the outer tube wall. Such a typical conductive substance may be a thermally conductive substance such as grease.

In one embodiment, the tube 82 may be about 0.85 inch in diameter, and the heating element 81 may be about 0.5 inch in diameter. Other sizes are possible.

In operation, the heating element is connected to a power source to deliver power to the heating element. Optionally, the power delivered may be up to 800 watts, while other wattages are possible.

The heating element 81 may be placed within the tube 82 so as to distribute the heat produced over its length in a substantially even manner, although even distribution is not a requirement of the invention. Heat may be transferred homogeneously over the length of the tube, or it may be provide differential heating over its length to optimize heat transfer. Controlling the heater element over the length results in more efficient and accurate heating of the $SF_6$ gas. Temperature and pressure measurements of the gas in the enclosure would be typical of the overall pressure/temperature distribution, predicting a more accurate gas density throughout the enclosure. The heater may include any number of sensor and control mechanisms. Such sensors and controls are known in the art and may include thermostatic sensors and controls for the heating element, temperature sensors and pressure sensors. Any number of measurements of physical parameters may be made by the sensors, including pressure, acoustical noise, partial discharge related electromagnetic noise, magnetic fields, and electromagnetic radiation.

Optionally, the heating element 81 may be assembled so as to provide heat only in areas desired. The heating assembly 80 may thus comprise any number of separable controllable heating elements 81 along the length of the heater 80. The tube 82 may generally extend the entire length of the tank 14, or it may have a closed end 83 to stop the tube inside the enclosure. Any suitable design may reduce electrical stresses at the tube end 83 to acceptable levels.

Another embodiment is a heater assembly 80 operable to be modularly placed into a tank 14 comprising insulating gas 36 of a circuit breaker 12, wherein the assembly comprises at least one heating element 81 fitted within in a retaining tube 82.

The heater tube 82 may function as a trap for conductive particles. Conductive particles located inside the enclosure may disturb the electrical field and may precipitate an electrical failure, causing circuit breaker malfunction and damage and creating a dangerous situation on the power line. These particles may be introduced in many ways and there is a significant historical and statistical basis that predicts a high probability of their presence inside the enclosure. It is therefore desirable to manage these particles to prevent failure.

Figure 5:
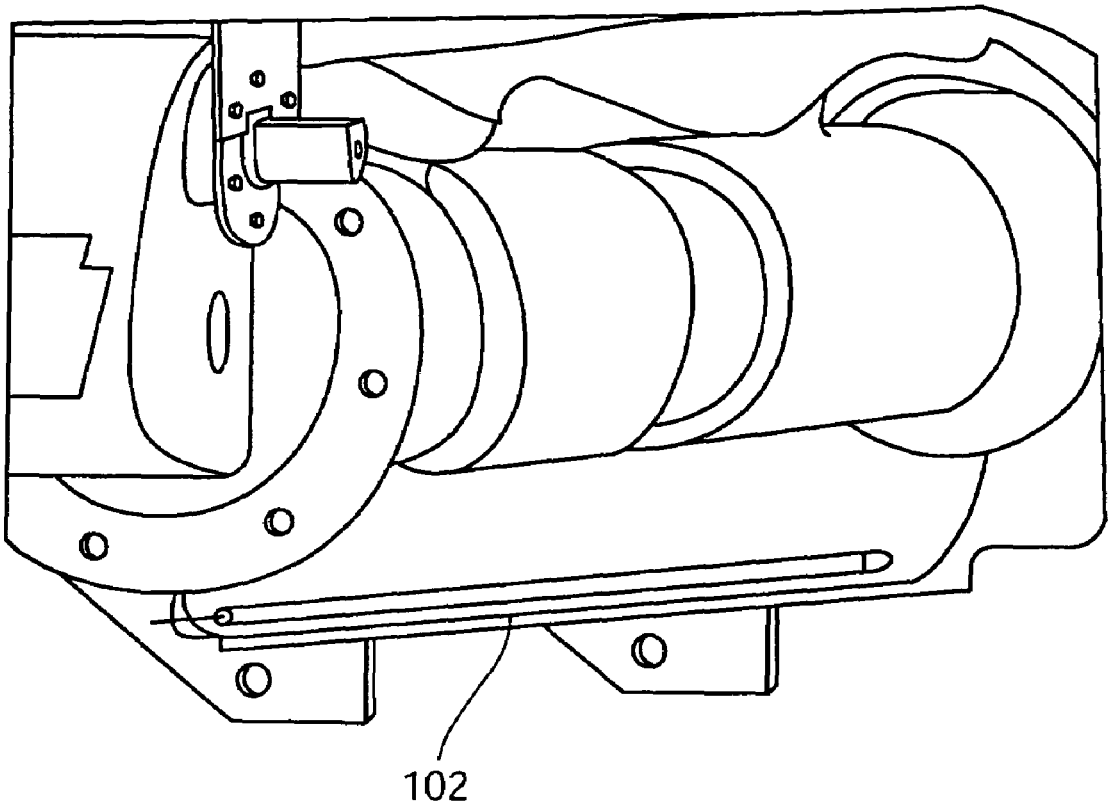
FIG. 5 is a cut-away cross-sectional side view of an interrupter in a tank, illustrating a particle trap region.

One method to trap conductive particles within the enclosure is to add a raised, conductive shape on the low region of the enclosure and ground it to the enclosure wall. This "trap" has a somewhat higher electrical stress near it than the surroundings and there is almost zero electrical stress under the trap. Referring to FIG. 5, one such trap is shown wherein the retaining tube 102 is positioned at the bottom of tank 14 and shaped in a concave form to serves as a particle trap. Other examples of traps are described in U.S. Pat. No. 6,307,172, the disclosure of which is herein incorporated by reference. Conductive particles move toward the trap due to oscillating electrical fields and gravity, bounce into the low electrical stress region under the trap, and are held there by gravity.

The heater tube may be positioned and shaped to effectively serve as a particle trap. A tube may be installed inside the tank even if heating of the $SF_6$ gas is not required for a particular circuit breaker installation. Optionally, the tube may be shaped in a U-design as such the trap described in U.S. Pat. No. 6,307,172, the disclosure of which is incorporated herein be reference, wherein the tube has a channel opening to the interior chamber and extending substantially along a length of the interior chamber of the tank; the channel having a generally U-shaped bottom, along opposite longitudinal sides of the channel the tube being shaped to curve downwardly into the channel in a manner convex in shape with respect to the interior chamber. The space or gap 100, located below the heater tube 82, in between the tank wall and the tube as seen in FIG. 4 may thus collect the conductive particles.

The heater assembly may be used in any variety of high-voltage gas-type circuit breakers. The present invention is not limited to the specific circuit breaker designs shown in FIGS. 1–5, but rather it may include any gas-type circuit breaker. While preferred embodiments have been described in detail, variations may be made to these embodiments without departing from the spirit or scope of the attached claims.

Optionally, in an embodiment for extremely low (e.g., able to withstand negative 45° C. or lower) temperature applications, the tank may be covered or substantially covered with an insulating material. Also optionally, multiple internal heaters may be used in a tank, or one or more internal heaters may be used in combination with a conventional external heater.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art, each of which are also intended to be encompassed by the following claims.

What is claimed is:

1. A circuit breaker comprising:

a contact mechanism movable between an open position and closed position;

a tank having an interior chamber enclosing the contact mechanism, wherein the interior chamber designed to accept an insulating gas; and a heating assembly comprising a heating element enclosed in an outer tube, wherein the heating assembly is located within the tank, wherein the outer tube is substantially surrounded by the insulating gas when the interior chamber is filled with the insulating gas.

2. The circuit breaker of claim 1, wherein the outer tube is formed to attract and trap foreign particles.

3. The circuit breaker of claim 1, wherein the insulating gas comprises one or more of sulfurhexafluoride, tetrafluromethane, nitrogen, carbon dioxide, and mixtures thereof.

4. The circuit breaker of claim 1, wherein the heating element is sealed from the surrounding insulating gas by the tube.

5. The circuit breaker of claim 1, wherein the heating element is accessible from the exterior of the tank through an opening of the tube.

6. The circuit breaker of claim 5, wherein the opening of the tube is equipped with a fitting.

7. The circuit breaker of claim 6, wherein the fitting includes one or more electrical wires.

8. The circuit breaker of claim 1 further comprising at least one additional heater.

9. The circuit breaker of claim 1, further comprising an insulation material surrounding at least a portion the exterior of the tank.

10. The circuit breaker of claim 1, wherein the heater is operable to supply substantially consistent heat over the length of the tube.

11. The circuit breaker of claim 1, wherein the heating element is operable to selectively supply different heating requirements over the length of the tube.

12. The circuit breaker of claim 1, wherein the tube is positioned along an axial length of a surface of the interior chamber.

13. The circuit breaker of claim 1, further comprising a thermostatic control for the heating element.

14. The circuit breaker of claim 1, wherein the tube contains a thermally conductive substance that surrounds the heating element.

15. A circuit breaker comprising:

a contact mechanism movable between an open position and closed position;

a tank having an interior chamber enclosing the contact mechanism, wherein the interior chamber designed to accept an insulating gas; and a heating assembly comprising a heating element enclosed in an outer tube, wherein the heating assembly is located within the tank, wherein the heating element is operable to selectively supply different heating requirements over the length of the tube, and wherein the outer tube is substantially surrounded by the insulating gas when the interior chamber is filled with the insulating gas.

16. The circuit breaker of claim 15, wherein the outer tube is formed to attract and trap foreign particles.

17. The circuit breaker of claim 15, wherein the heating element is sealed from the surrounding insulating gas by the tube, and the heating element is accessible from the exterior of the tank through an opening of the tube.

18. The circuit breaker of claim 15, wherein the tube contains a thermally conductive substance that surrounds the heating element.

19. A circuit breaker comprising:

a contact mechanism movable between an open position and closed position;

a tank having an interior chamber enclosing the contact mechanism, wherein the interior chamber designed to accept an insulating gas; and a heating assembly comprising a heating element enclosed in an outer tube that is formed to attract and trap foreign particles, wherein the heating assembly is located within the tank.

20. The circuit breaker of claim 15, wherein the tube contains a thermally conductive substance that surrounds the heating element.

* * * * *